United States Patent [19]

Masaki et al.

[11] 4,013,052

[45] Mar. 22, 1977

[54] EXHAUST GAS RECIRCULATION CONTROL DEVICE

[75] Inventors: Kenji Masaki; Shuya Nambu, both of Yokohama, Japan

[73] Assignee: Nissan Motor Co., Ltd., Yokohama, Japan

[22] Filed: May 1, 1975

[21] Appl. No.: 573,620

Related U.S. Application Data

[62] Division of Ser. No. 391,533, Aug. 27, 1973, Pat. No. 3,896,777.

[30] Foreign Application Priority Data

Aug. 31, 1972 Japan ..... 47-86711

[52] U.S. Cl. ..... 123/119 A

[51] Int. Cl.[2] ..... F02M 25/06

[58] Field of Search ..... 123/119 A

[56] References Cited

UNITED STATES PATENTS

| | | | |
|---|---|---|---|
| 3,739,797 | 6/1973 | Caldwell | 123/119 A |
| 3,774,583 | 11/1973 | King | 123/119 A |
| 3,779,222 | 12/1973 | Lorenz | 123/119 A |
| 3,835,827 | 9/1974 | Wolgemuth | 123/119 A |
| 3,884,200 | 5/1975 | Caldwell | 123/119 A |

*Primary Examiner*—Wendell E. Burns

[57] ABSTRACT

A device which modulates intake manifold vacuum with venturi vacuum to actuate an exhaust gas recirculation control valve.

2 Claims, 4 Drawing Figures

EXHAUST GAS RECIRCULATION CONTROL DEVICE

This is a division of application Ser. No. 391,533, filed Aug. 27, 1973, now U.S. Pat. No. 3,896,777.

The present invention relates to an exhaust gas recirculation system for an internal combustion engine, and more particularly to a modulating device for an intake manifold vacuum actuated exhaust gas flow control valve for an exhaust gas recirculation system for an internal combustion engine.

Heretofore, there have been many proposals to introduce, throughout all operating conditions of an internal combustion engine, an inert gas such as exhaust gas into the intake system; i.e. into the intake manifold or into the induction passage at a location downstream of the air filter; with the intention of reducing the concentration of nitrogen oxides ($No_x$) in the engine exhaust gases by suppressing their formation. It is required that a suitable amount of exhaust gas be introduced into the intake system of the engine to attain satisfactory results. A reduction in engine performance results if the ratio of the flow rate of recirculated exhaust gas to that of intake air exceeds a certain optimum value, and failure to suppress the formation of nitrogen oxides results if the ratio is much smaller than the certain optimum value. If intake manifold vacuum is employed to actuate a valve to meter the flow of exhaust gas into the intake system of the engine, as is common in the prior art, it is hardly possible to maintain the flow rate ratio of recirculated exhaust gas to intake air at an optimum value mostly due to the fact that the vacuum in the intake manifold does not vary in proportion to the intake air flow rate throughout operation of the engine.

It has been confirmed that the vacuum in the venturi of a carburetor varies in relation to the velocity of air flowing through the venturi throughout operation of the engine, and therefore in relation to the flow rate of intake air being introduced into the engine. Thus, if the vacuum in the venturi is employed as a parameter in controlling the amount of exhaust gas introduced into the intake system, the flow rate of exhaust gas can be metered to an optimum ratio to that of intake air throughout all modes of operation of the engine. However, the vacuum in the venturi is insufficient for adequate control of a vacuum actuated valve to meter the flow rate of recirculated exhaust gas.

It is accordingly a primary object of the present invention to provide a modulating device for a vacuum actuated valve of an exhaust gas recirculation system for an internal combustion engine, by which a suitable amount of exhaust gas can be introduced into the intake system throughout the operation of the engine.

It is another object of the present invention to employ, as a parameter, the vacuum in the venturi of a carburetor of an engine for controlling the amount of exhaust gas introduced into the intake system so that the flow rate of recirculated exhaust gas will vary in accordance with that of intake air.

These and other objects, features and advantages of the present invention will become clear as this description progresses with reference to the accompanying drawings, wherein.

Figure 1:
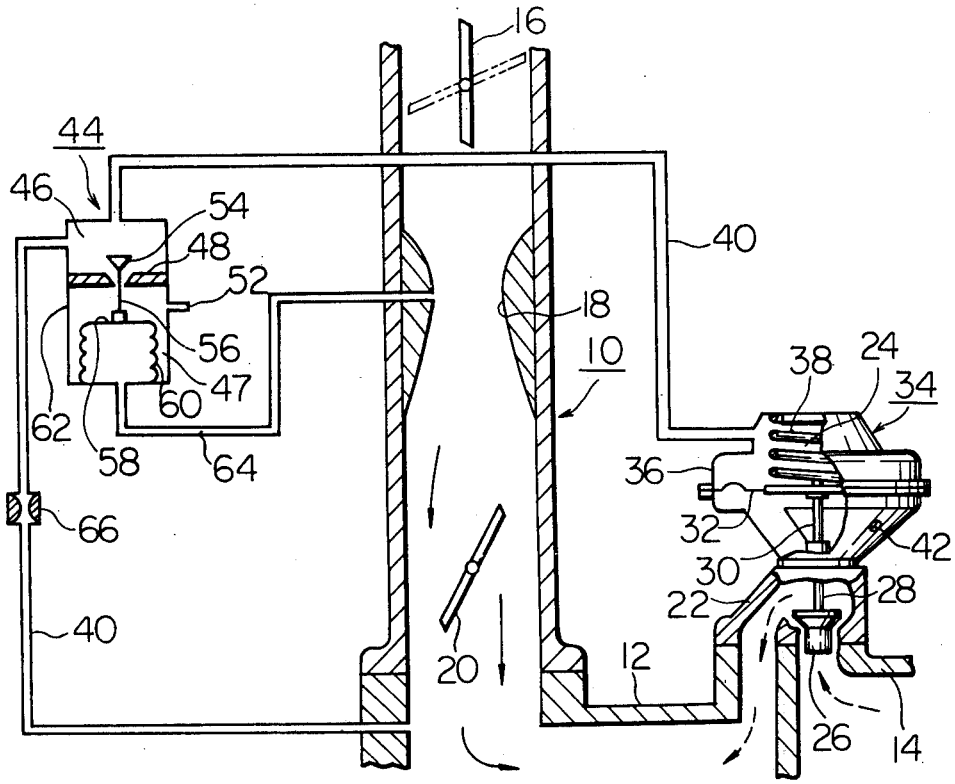
FIG. 1 shows an exhaust gas recirculation system incorporating a modulating device according to one embodiment of the present invention.

Referring to FIG. 1, an exhaust gas recirculation system incorporating a modulating device of the present invention is shown as incorporated into an internal combustion engine which may be of any conventional design, being provided with a usual carburetor 10, intake manifold 12, and exhaust pipe 14 leading from an exhaust manifold (not shown). The carburetor 10 is provided with a choke valve 16, venturi section 18 and throttle valve 20.

The exhaust gas recirculation system includes an exhaust gas recirculation conduit 22 connecting the exhaust pipe 14 with the intake manifold 12 to recirculate a portion of the engine exhaust gas to the intake manifold 12. Provided in the recirculation conduit 22 is a normally closed metering valve 26 to control the amount of exhaust gas recirculated to the intake manifold 12 through the recirculation conduit 22. The metering valve 26 has a valve stem 28 which at its upper end is secured to a plunger 30 which in turn is fastened at its upper end to the center of a diaphragm 32 of a diaphragm device generally designated as 34. The diaphragm 32 is disposed in a casing 36 secured to the recirculation conduit 22. A spring 38 biases the diaphragm 32 downwardly as shown. A chamber 24 above the diaphragm 32 is connected by a conduit 40 to the intake manifold 12. A chamber below the diaphragm 32 (no numeral) is open to the atmosphere through a plurality of apertures, one being shown and designated as 42.

A modulating device 44 according to the present invention is interposed in the conduit 40. A portion (no numeral) of the conduit 40 leading from the intake manifold 12 opens into a first chamber 46 of a casing 62 of the modulating device 44. A partition 48 divides the interior of the casing 62 into the first chamber 46 and a second chamber 47. A valve 54 is disposed in the partition 48 to control communication between the chambers 46 and 47. A stem 56 of the valve 54 is operatively attached to a movable end portion 58 of a pressure responsive membrane means which is shown as being a bellows 60, the other end portion (no numeral) of the bellows 60 being fixed to the bottom of the chamber 47 as shown. A port 52 vents the chamber 47 to the atmosphere. A first conduit 64 connects the interior of the bellows 60 through a hole (no numeral) in the casing 62 to the venturi section 18. A restriction 66 is provided in the conduit 40 as shown to limit gas flow therethrough.

The device of FIG. 1 operates as follows:

During operation of the engine, the velocity of air flowing through the venturi section 18 and accordingly the level of vacuum therein increase as the throttle valve 20 opens. This increase of vacuum level in the venturi section 18 causes the bellows 60 to collapse, moving the valve 54 downwardly to reduce the air flow into the chamber 46 above the partition 48 through the port 52 and chamber 47. Thus, the pressure in the chamber 46 approaches the vacuum level in the intake manifold 12 as the vacuum in the venturi section 18 increases, and decreases as the vacuum in the venturi section 18 decreases. Since the chamber 24 above the diaphragm 36 of the diaphragm device 34 communicates with the chamber 46 through the conduit 40, the valve 26 will be actuated in response to the vacuum level in the chamber 46, thereby allowing a suitable quantity of exhaust gas to flow through the valve 26 into the intake manifold 12.

Figure 2:
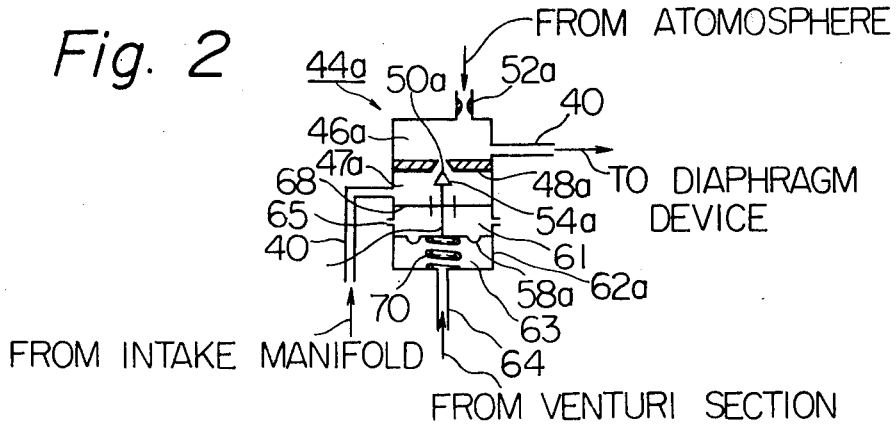
FIG. 2 shows a modulating device according to another embodiment of the present invention.

FIG. 2 shows an improved embodiment of a control device of the present invention.

In the embodiment of FIG. 1, the valve 26 may fully open during a warming-up operation of the automobile in cold weather, at which time the choke valve 16 is nearly closed (see the phantom position of the choke valve 16 in FIG. 1), thereby creating a relatively high vacuum in the venturi 18 to cause the valve 54 to fully close. Thus, a relatively large amount of exhaust gas will be introduced into the intake manifold 12 relative to the amount of intake air introduced thereinto to impair the drivability of the automobile during the warming-up operation. To eliminate this condition, FIG. 2 shows an improved control device which can be applied in the exhaust gas recirculation system of FIG. 1.

A modulating device of FIG. 2 is indicated generally as 44*a*. The portion of the pipe 40 leading to the diaphragm device 34 opens into a first chamber 46*a* of a casing 62*a*, which is vented to the atmosphere through a restricted port 52*a*. A valve 52*a* is disposed in a first partition 48*a* and controls communication therethrough between the first chamber 46*a* and a second chamber 47*a*. The chamber 47*a* communicates with the intake manifold 12 through the other portion of the conduit 40. A valve stem 56*a* of the valve 54*a* passes through a second partition 68 in a gas tight manner, and is connected at its bottom end as shown to a diaphragm 58*a*. The diaphragm 58*a* divides the space in the casing 62*a* below the partition 68 into an upper (as shown) or third chamber 61 and a lower (as shown) or fourth chamber 63. The chamber 61 is vented to the atmosphere through at least one aperture 65. A spring 70 disposed in the chamber 63 biases the diaphragm 58*a* upwards as shown and thus the valve 54*a* to a closed position. The chamber 63 communicates with the venturi section 18 through the conduit 64.

The device of FIG. 2 operates as follows:

As the vacuum in the venturi section 18 increases, the vacuum in the chamber 63 increases accordingly, so that the pressure difference across the diaphragm 58*a* counteracts the action of the spring 70 and causes the valve 54*a* to open. However, since the chamber 46*a* is open to the atmosphere and the spring 70 biases the valve 54*a* upwardly toward a closed position, the vacuum from the intake manifold 12 in the chamber 46*a* can be modulated even during a warming-up operation of the automobile, thus preventing an excessive amount of exhaust gas from flowing through the valve 26 provided in the exhaust gas recirculation conduit 22.

Figure 3:
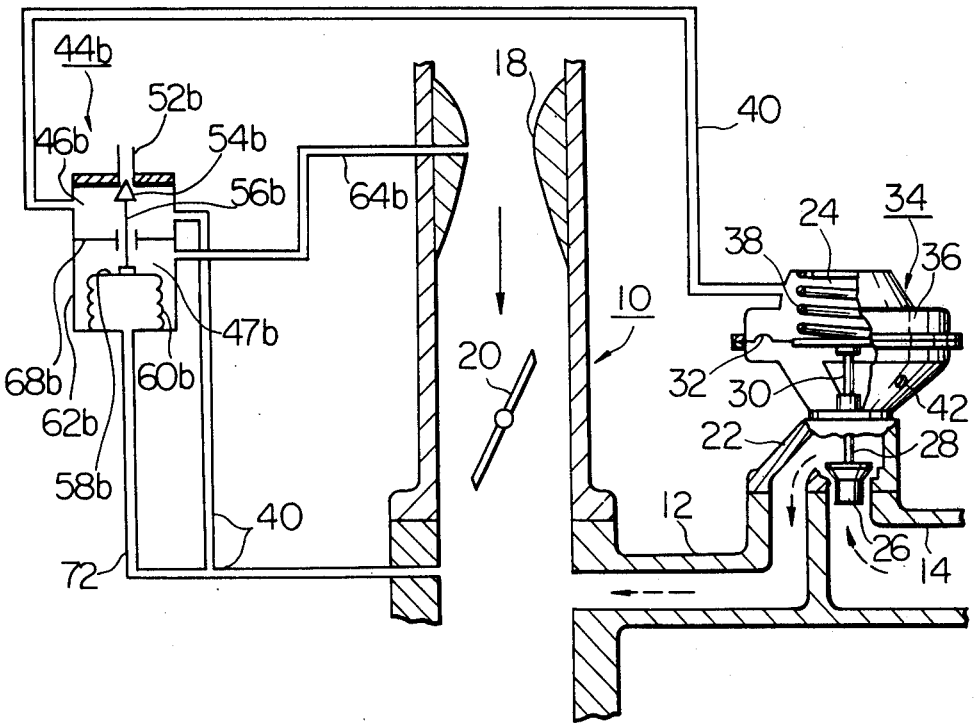
FIG. 3 shows a modulating device according to still another embodiment of the present invention.

FIG. 3 shows another embodiment of the present invention.

During operation of an automobile, there may occur a condition such that the vacuum in the intake manifold 12 varies in dependence on the engine speed at different intake air flow rates depending on the engine loading. Thus, it may be necessary to adjust the air flow into the chamber 46 (of FIG. 1) so that the vacuum applied to the chamber 24 above the diaphragm 32 of the diaphragm device 34 may vary in relation to the flow rate of intake air under such a condition. For this purpose, FIG. 3 shows an exhaust gas recirculation system analogous to that of FIG. 1 but includes instead of the modulating device 44 of FIG. 1 a modulating device 44*b* interposed in the conduit 40. In this embodiment, a first chamber 46*b* of a casing 62*b* communicates with the upper chamber 24 of the diaphragm device 34 and the intake manifold 12 through respective portions of the conduit 40, and also with the atmosphere through a port 52*b*. A partition 68*b* divides the interior of the casing 62*b* into the first chamber 46*a* and a second chamber 47*b*. A valve 54*b* is disposed in the casing 62*b* to control communication between the chamber 46*b* and the atmosphere through the port 52*b*. A valve stem 56*b* of the valve 54*b* passes through partition 68*b* in a gas tight manner, and is attached to a movable end portion 58*b* of a bellows 60*b* disposed in the chamber 47*b* in a manner described with reference to FIG. 1. The interior of the bellows 60*b* communicates with the intake manifold 12 through a second conduit 72, and the chamber 47*b* communicates with the venturi section 18 through a first conduit 64*b*.

The device of FIG. 3 operates as follows:

During operation of the automobile, as the throttle valve 20 is gradually opened, the vacuum in the venturi section 18 increases. This increase in the vacuum in the venturi section 18 causes the bellows 60*b* to expand and the valve 54*b* to move upwardly toward a closed position. Thus, the vacuum in the chamber 24 above the diaphragm 32 of the diaphragm device 34 increases, thereby increasing the amount of exhaust gas being introduced into the intake manifold 12. Where, however, the vacuum in the intake manifold 12 increases whereas the vacuum in the venturi section 18 remains unchanged, the valve 54*b* moves downwardly toward an open position. It is now seen that in the device of FIG. 3, the vacuum in the chamber 24 above the diaphragm 32 of the diaphragm device 34 can be prevented from increasing excessively so that the amount of exhaust gas being introduced into the intake manifold 12 under such a condition that the vacuum in the intake manifold 12 increases but the vacuum in the venturi section 18 remains unchanged does not undesirably increase.

Figure 4:
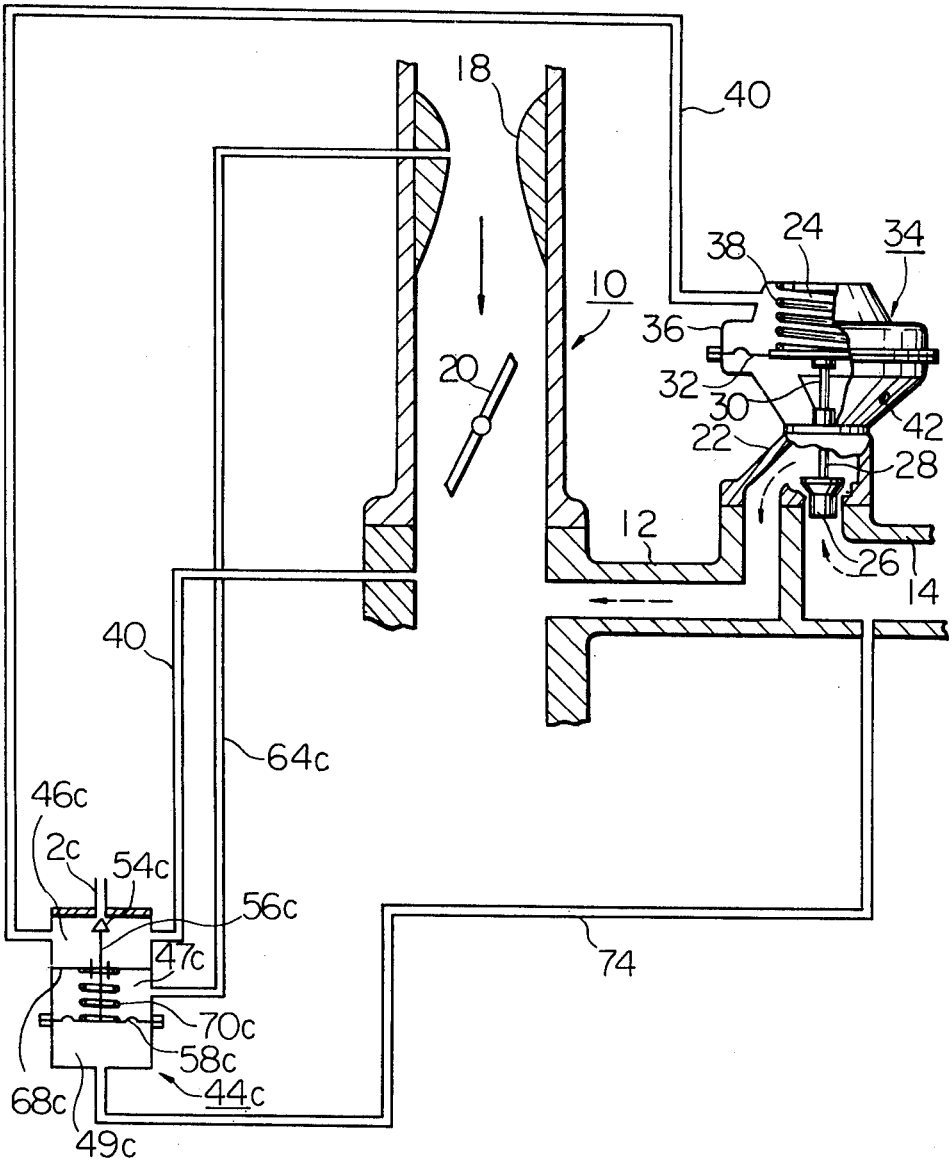
FIG. 4 shows a modulating device according to still a further embodiment of the present invention.

FIG. 4 shows still another embodiment of a control device of the present invention.

A modulating device of FIG. 4 now designated generally as 44*c* employed the exhaust gas recirculation system of FIG. 1 includes a first chamber 46*c*, a second chamber 47*c*, and a third chamber 49*c* communicating as shown. A valve 54*c* controls communication between the chamber 46*c* and the atmosphere through a port 52*c*, and has a valve stem 56*c* passing through a partition 68*c* in a gas tight manner and connected to a diaphragm 58*c*. A spring 70*c* biases the diaphragm downwardly as shown and the valve 54*c* toward an open position. In this embodiment the chamber 49*c* is connected to the exhaust pipe 14 through a third conduit 74.

The device of FIG. 4 operates as follows:

During operation of the automobile, as the vacuum in the venturi section 18 increases, the valve 54*c* will move toward a closed position to block the port 52*c*. If the vacuum in the intake manifold 12 increases while the vacuum in the venturi section 18 remains unchanged, the valve 54*c* will move further downwardly to increase the degree of opening of the valve 54*c* and port 52*c* due to the pressure in the exhaust pipe 14, because the pressure in the exhaust pipe 14 decreases as the vacuum in the intake manifold 12 increases. If, on the other hand, the vacuum in the intake manifold 12 decreases, as when the throttle valve 20 is opened wider, the valve 54*c* moves further upwardly to block the port 52*c* due to the pressure in the exhaust pipe 14 because the pressure in the exhaust pipe 14 increases as the vacuum in the intake manifold 12 decreases.

In this way, in the control device of FIG. 4, the vacuum in the chamber 24 above the diaphragm 32 of the diaphragm device 34 can be controlled in response to the magnitude of the vacuum in the venturi section 18.

What is claimed is:

1. In an exhaust gas recirculation system having a recirculation conduit to recirculate a portion of exhaust gases from the exhaust system of an internal combustion engine to the intake system thereof having a carburetor; a vacuum actuated exhaust gas flow metering valve normally closing the recirculation conduit; a diaphragm device operatively connected to the metering valve and a vacuum conduit connecting the spring loaded side of the diaphragm device to the intake manifold for actuation of the diaphragm device by the intake manifold vacuum to operate the metering valve, a modulating device comprising a casing having a chamber, partition means dividing said chamber into a first compartment and a second compartment, said first compartment forming part of said vacuum conduit, means defining a bleed port opening to said first compartment, a valve to control air flow rate through said bleed port, a bellows in said second compartment, one end of said bellows being operatively connected to said valve, an opposite end of said bellows being securely fixed to said casing, a first conduit means connecting said compartment to the venturi of said carburetor and a second conduit means connecting the interior of said bellows to said intake manifold.

2. In an exhaust gas recirculation system as claimed in claim 1, in which said valve normally closes said bleed port and said valve is movable by said bellows to an open position.

* * * * *